US006904979B1

(12) United States Patent
Confoey

(10) Patent No.: US 6,904,979 B1
(45) Date of Patent: Jun. 14, 2005

(54) TOWABLE EARTH WORKING APPARATUS HAVING ADJUSTABLE WHEEL HEIGHT

(75) Inventor: Richard J. Confoey, Berlin Center, OH (US)

(73) Assignee: Sekely Industries, Inc., Salem, OH (US)

( * ) Notice: Subject to any disclaimer, the term of this patent is extended or adjusted under 35 U.S.C. 154(b) by 32 days.

(21) Appl. No.: 10/663,958

(22) Filed: Sep. 16, 2003

(51) Int. Cl.[7] ..... E02F 3/76
(52) U.S. Cl. ..... 172/799.5
(58) Field of Search ..... 172/197, 199, 172/396, 605, 200, 784, 788, 799, 799.5, 172/779, 797, 684.5, 448, 449; 280/43.23, 280/460.1, 461.1

(56) References Cited

U.S. PATENT DOCUMENTS

| | | | | |
|---|---|---|---|---|
| 2,219,159 A | | 10/1940 | Flynn et al. | |
| 2,336,124 A | | 12/1943 | Phoenix | |
| 2,615,262 A | | 10/1952 | Reid, Sr. | |
| 3,097,439 A | | 7/1963 | Calkin | |
| 3,548,956 A | | 12/1970 | Hochsteller | |
| 3,876,013 A | | 4/1975 | Dunn | |
| 3,907,041 A | | 9/1975 | Manor | |
| 4,119,225 A | | 10/1978 | Macht et al. | |
| 4,217,962 A | * | 8/1980 | Schaefer | 172/197 |
| 4,388,769 A | | 6/1983 | Miskin | |
| 4,411,323 A | | 10/1983 | Doss | |
| 4,422,818 A | | 12/1983 | Molby | |
| 4,620,381 A | | 11/1986 | Plyler et al. | |
| 4,635,730 A | | 1/1987 | Larsson | |
| 4,698,150 A | | 10/1987 | Wigoda | |
| 4,809,449 A | | 3/1989 | Solaja | |
| 4,940,096 A | | 7/1990 | Johnson | |
| 4,942,934 A | | 7/1990 | Moriarty | |
| 5,127,172 A | | 7/1992 | Lund et al. | |

(Continued)

FOREIGN PATENT DOCUMENTS

DE 3340470 A1 5/1985

OTHER PUBLICATIONS

Bobcat Brochure entitled: "Attachments for Loaders"; B-1595; (Melroe #6724297).

*Primary Examiner*—Robert E Pezzuto
(74) *Attorney, Agent, or Firm*—Robert J. Herberger

(57) ABSTRACT

A towable earth working apparatus for landscaping, leveling, grading, cutting and for spreading dirt, sand, gravel, is hitched by a trailer arm to a vehicle such as a small tractor or pickup truck. The apparatus has a grader secured to a trailer having a carriage frame with a wheel support assembly attached to a pivot attachment mechanism. The wheel support assembly supports laterally spaced wheels about a journal axis. A wheel support actuator is connected to the journal axis for transmitting actuator movement to the wheel support assembly, where the wheels pivot in both angular directions about the journal axis, to raise and lower the wheels relative to the grader, changing the grader's height. The angular inclination of the grader relative to a reference plane, and consequently the angular inclination of a cutting blade mounted on the grader, is still further adjusted by a pivot attachment actuator, such as a turnbuckle, of the pivot attachment mechanism.

19 Claims, 8 Drawing Sheets

U.S. PATENT DOCUMENTS

| | | | |
|---|---|---|---|
| 5,181,574 | A | 1/1993 | Dion |
| 5,289,880 | A | 3/1994 | Barto |
| 5,392,864 | A | 2/1995 | Lindenmuth |
| 5,697,731 | A | 12/1997 | Bonds |
| 5,701,693 | A | 12/1997 | Brocious et al. |
| 5,775,438 | A | 7/1998 | Confoey et al. |
| 6,032,746 | A | 3/2000 | Lowery |
| 6,347,670 | B1 | 2/2002 | Miskin |

* cited by examiner

TOWABLE EARTH WORKING APPARATUS HAVING ADJUSTABLE WHEEL HEIGHT

BACKGROUND OF THE INVENTION

1. Field of the Invention

This invention relates to the field of earth working equipment for landscaping, leveling, finish grading, cutting and spreading dirt, sand, gravel and the like. More particularly, the invention relates to such an apparatus capable of being towed by a light vehicle.

2. Description of the Prior Art

Ground surface grading devices for leveling and finish grading of rough terrain after preliminary smoothing by heavy equipment, such as a bulldozer or heavy tractor, have been available for many years. Grading equipment that can be shifted from one vehicle to another for greater operational flexibility is known and available commercially. Nevertheless, heavy-duty equipment, such as an earthmover or commercial tractor, must tow these devices.

Many potential operators of grading equipment, private individuals, businesses and local governments, do not have ready access to, or need heavy equipment to perform their work. But most operators usually have a vehicle such as a light truck, pickup truck, or small tractor that can be used for landscaping, ground leveling, finish grading, earth cutting, and for spreading dirt, sand, gravel and other such material at worksites, playing fields, gravel or dirt driveways and pathways, drainage culverts, and motor-cross tracks.

Most earth moving equipment is operated hydraulically via lines extending from the towing vehicle. Large equipment requires a reservoir of several gallons of hydraulic fluid for proper operation. Heavy-duty towing equipment may be able to provide such capacity, but vehicles normally employed by a private user cannot readily accommodate a large supplemental reservoir of hydraulic fluid. Instead, light vehicles must be modified to provide proper operation of the conventional towable earth working equipment, provided that the vehicles have the capacity to haul them. Such modifications increase the cost of the equipment and compromise operation of the vehicle. A more suitable towed apparatus would operate using hydraulic systems and other actuation equipment readily available to owners of light vehicles.

U.S. Pat. No. 5,289,880 describes a towable road grader for use behind a small vehicle, such as a pickup truck, the grader being either centered directly behind the towing vehicle or offset from center. A support frame secures a tending tool, a wheel frame pivots the rear towing wheels either toward or away from the support frame, and an attachment frame joins the other two frames to a hitch on the towing vehicle. The attachment frame keeps the support frame parallel to the plane of the underlying roadway surface as the support frame is raised or lowered. The attachment frame pivots upward when the tending tool is lowered to the roadway surface. As the wheels are raised and lowered, the cutting blade is raised and lowered. However, raising and lowering the wheels does not change the angular position of the blade relative to a horizontal plane or the ground surface. If the inclination of the blade were so changed, it would facilitate its engagement with the soil as ground conditions change and as the work requires.

U.S. Pat. No. 6,347,670 describes a device for modifying the ground surface by removing soil, moving the soil to a new location, and filling low areas. It includes a frame carried by wheels, a tongue mounted to the frame for attachment to a tractor, a cutting blade mounted on the frame, and a bucket pivotally mounted to the frame to receive soil cut by the blade. The wheels are pivotally mounted to the frame for movement about the back wall and floor of the bucket between a first position and second position. The position of the wheels is not adjustable between the extremities of travel between the first and second positions.

It would be desirable to have a device that is towable behind a light vehicle for moving over rugged ground or a smoother surface on which soil, sand, or gravel are to be moved or graded. It is desired to have an earth working apparatus that includes a grader supported on a frame by wheels that can be raised and lower over an adjustable range. Preferably, the grader would include a cutting blade that is easily raised and lowered as the wheels are raised and lowered, and its angular disposition adjustable relative to the horizontal. Also, it is preferable to have a grader that can be easily configured to make a number of different profiles for various working sites, such as a level field for sporting events or a contoured ditch for drainage.

SUMMARY OF THE INVENTION

An earth working apparatus according to this invention includes a trailer for attachment to a towing vehicle. The trailer includes a grader adjustably secured to a carriage, a wheel support assembly and a pivot attachment mechanism. The wheel support assembly rotatably supports laterally spaced wheels about a pivoting journal axis. A pivot attachment actuator and a wheel support actuator are connected to the frame via the attachment mechanism, which transmits actuator movement to the grader and wheel support assembly to raise and lower the grader and to adjust the angular disposition its blades. More specifically, the wheel support assembly pivots as a unit in opposite angular directions about the journal axis in response to the wheel support actuator, which raises and lowers the grader relative to the ground, and the angular disposition of the grader is adjusted in response to movement of the pivot attachment actuator.

The wheels, which provide ground support at the rear of the apparatus, are secured to the carriage frame by a wheel support assembly having arms extending from a jackshaft, which is supported on a journal. Pivoting movement of the wheels by simply changing the length of the wheel support actuator raises and lowers the wheels relative to the grader and changes the height of implements attached thereto, relative to a reference horizontal plane.

It is an object of this invention to provide an earth working apparatus that performs its work while being towed by a small vehicle such as a tractor or pickup truck. In addition to its ability to easily change the height of the grader, the inclination of the cutting blade and other implements on the grader are easily adjusted by simply changing the length of the pivot attachment actuator, such as a turnbuckle.

It is a further advantage that the angular position of the wheels, their height, the height of the cutting blade and its inclination are all adjusted and manipulated to achieve the optimum position by lengthening and shortening the pivot attachment actuator and the wheel support actuator linked by the pivot attachment mechanism.

The carriage frame is pivotally connected to the grader so that in operation the wheels extend rearward away from the grader. When the work is completed, the rear wheels are lowered and move forward, closer to and more directly under the grader, thereby transferring a significant portion of the apparatus weight to the wheels. When the tending tool has been lifted well off the ground surface, the apparatus is easily towed to another location.

It is another advantage that changes in the pivot attachment actuator's length are transmitted through the pivot attachment mechanism having an inherent mechanical advantage so that the inclination of the grader is adjusted with minimum effort.

Additionally, the apparatus is shock-mounted to the carriage frame in order to minimize damage from a rough roadway. Vibrations transmitted by the wheels to the wheel support assembly of the apparatus from irregular land surfaces are attenuated to the pivot attachment mechanism. The shock absorbing ability of the pivot attachment mechanism, in combination with the extenuated length of the trailer, dampens ground-induced vibrations and holds the grader at a relatively uniform elevation while passing over rough terrain.

Another aspect of the present invention includes interchangeable and adjustable rear blades attached to adjustment plates. Located at the perimeter of each adjustment plate are angularly spaced positioning holes, with which to adjust the angle of the rear blades.

Other objects and advantages of this invention will become apparent to those skilled in the art from the following detailed description of the preferred embodiment, when read in light of the accompanying drawings.

BRIEF DESCRIPTION OF THE DRAWINGS

It is to be understood that the drawings are designed for the purpose of illustration only and not as a definition of the limits of the instant invention, for which reference should be made to the claims appended hereto. Other features, objects and advantages of this invention will become clear from the following more detailed description made with reference to the drawings in which:

DETAILED DESCRIPTION OF THE PREFERRED EMBODIMENT

Figure 1:
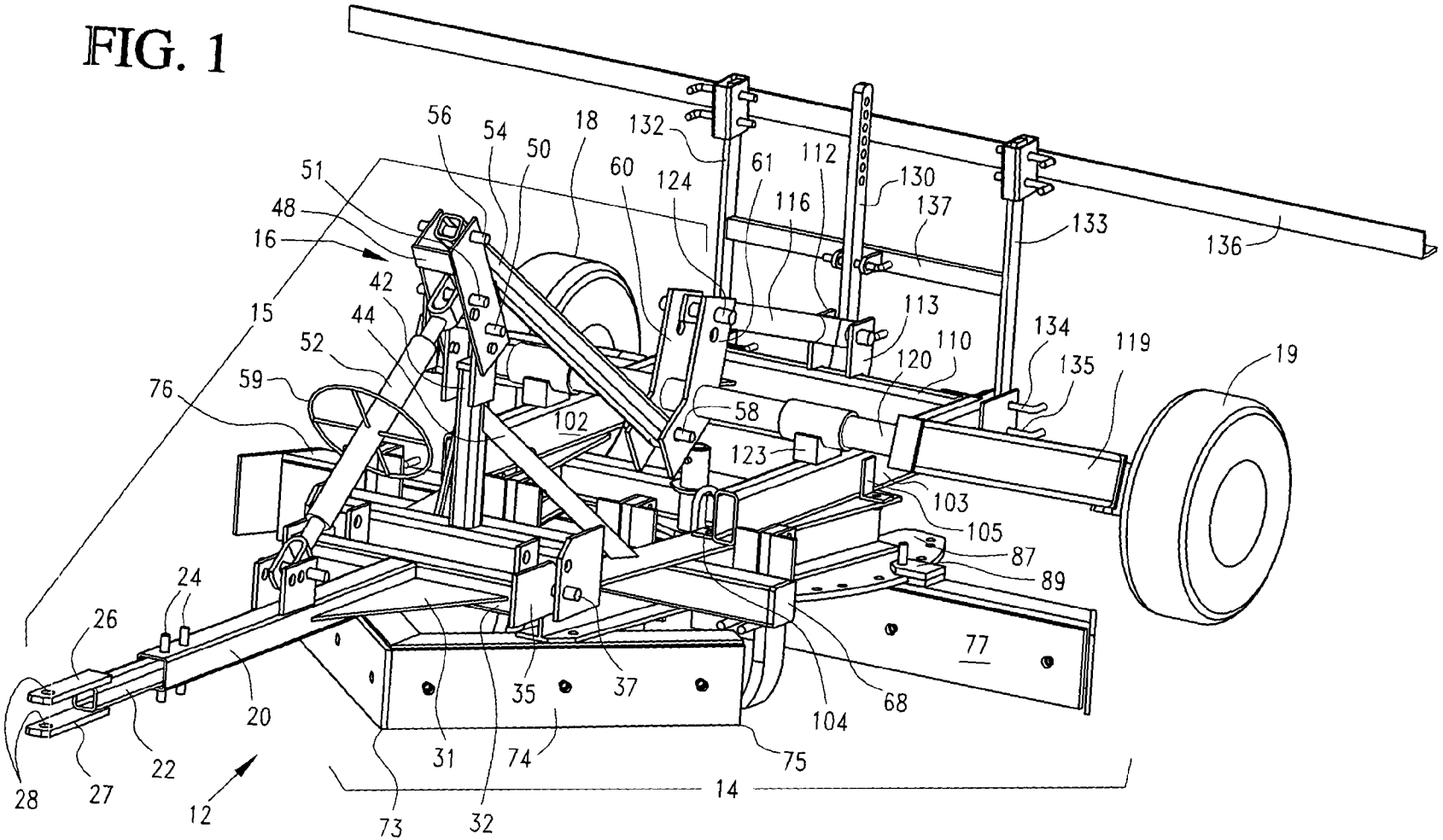
FIG. 1 is a perspective view of the apparatus having a trailer with a grader portion for attachment to a tow vehicle.

Referring now to the drawings, an earth working apparatus 12 includes a trailer supporting a grader portion 14 having earth working implements. The trailer 15 includes a carriage frame 17 for supporting the grader portion on wheels 18, 19 and a pivot attachment mechanism 16 for connecting the entire apparatus to a vehicle that tows the apparatus.

Figure 2:
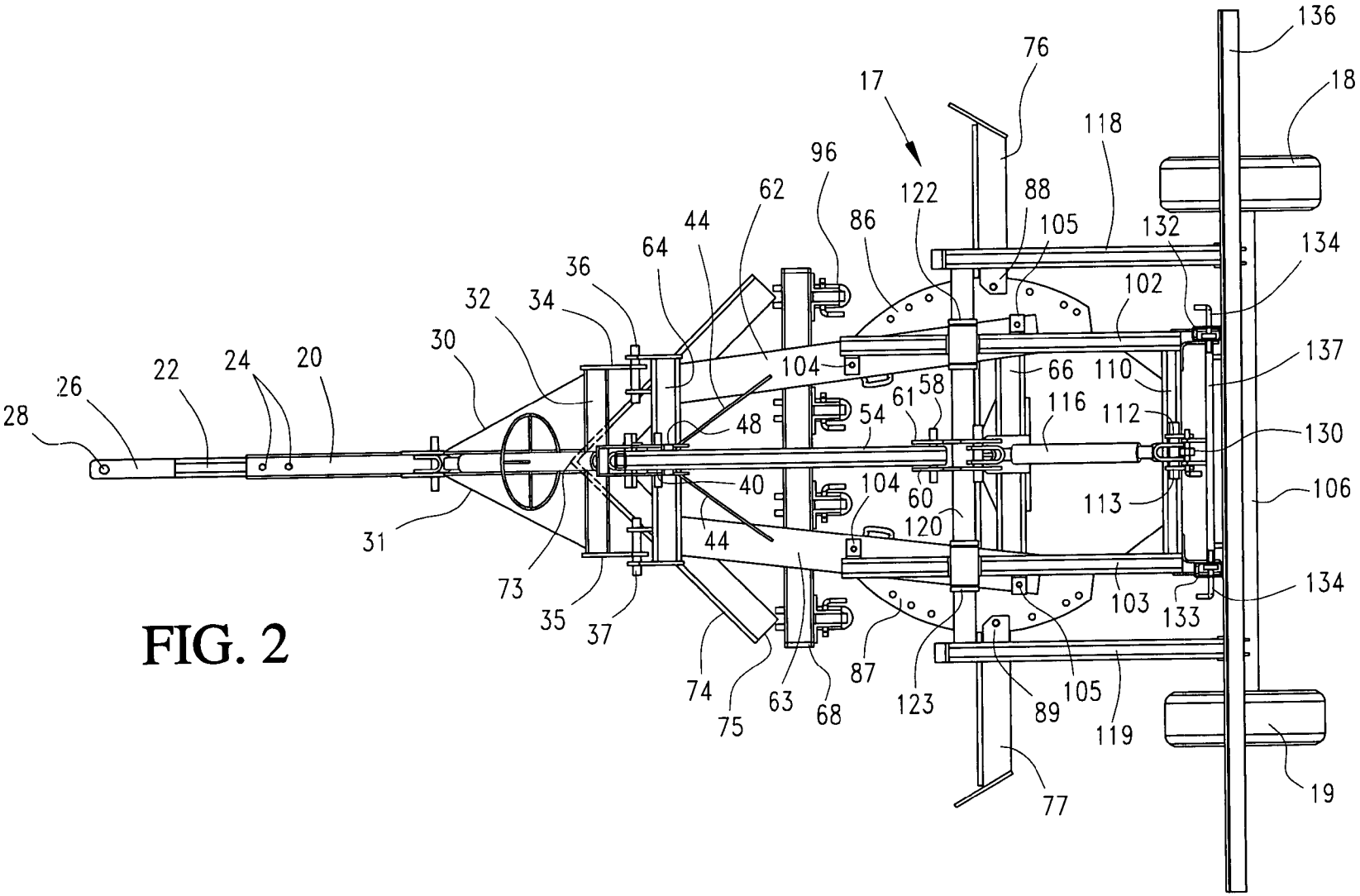
FIG. 2 is a plan view of the apparatus.
Figure 3:
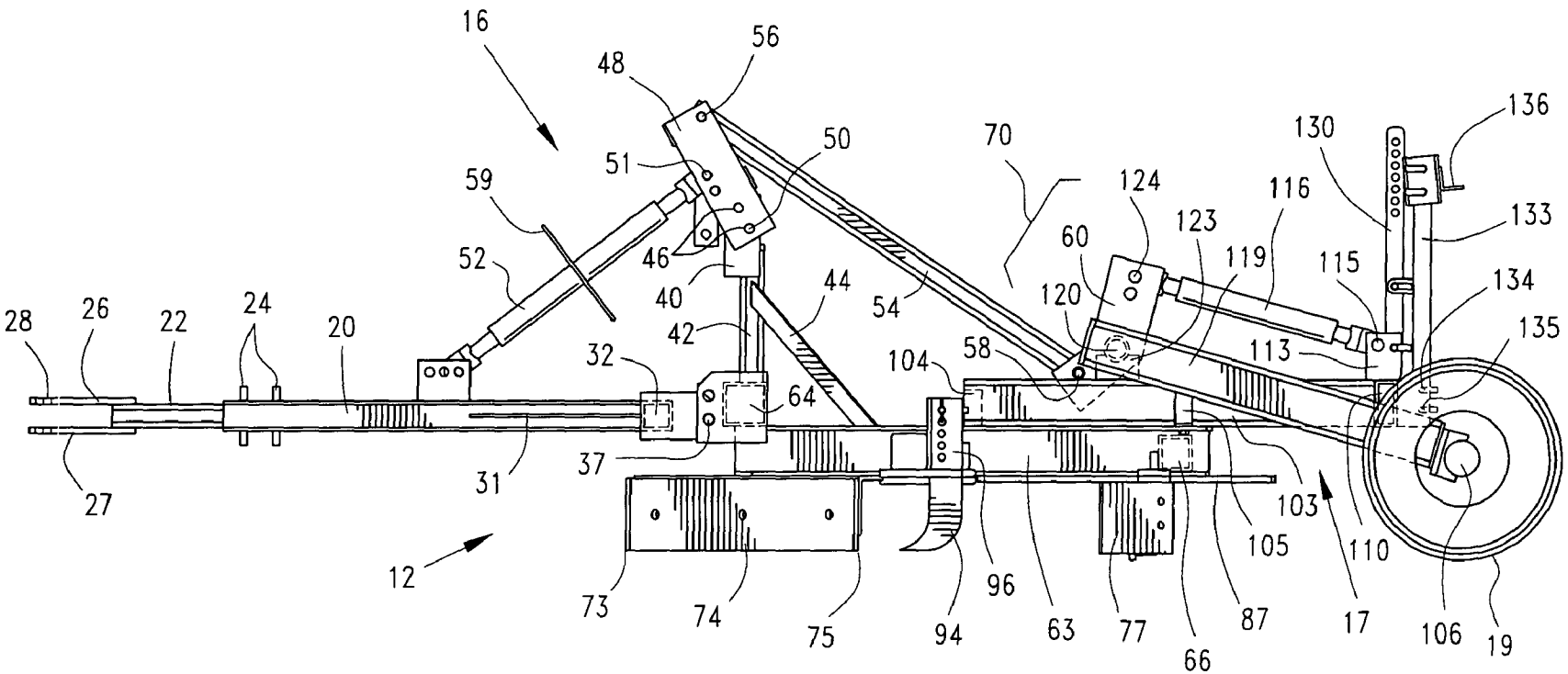
FIG. 3 is a side elevation view of the apparatus.

As FIGS. 1–3 show, the trailer 15 provides at its front end the pivot attachment mechanism 16 having a hitching assembly, which includes an attachment arm 20, in the form of a hollow rectangular tube, and a shorter tube 22 fitted within and secured to the arm 20 by pins or bolts 24. Tube 22 carries a pair of plates 26, 27, each plate having a through hole 28 adapted to receive a trailer hitch pin, which is secured to the vehicle (not shown therein) after engaging the holes 28. Of course, tube 22 can be easily removed and replaced, to receive a trailer towing ball, by pulling pins 24 and substituting it with another tube 22 having a ball hitch (not shown). The opposite end of the arm 20 is secured by triangular plates 30, 31 to a cross beam 32, which extends laterally. Each lateral end of the beam 32 supports an end plate 34, 35, which is attached by pins 36, 37 to the grader 14.

Figure 8:
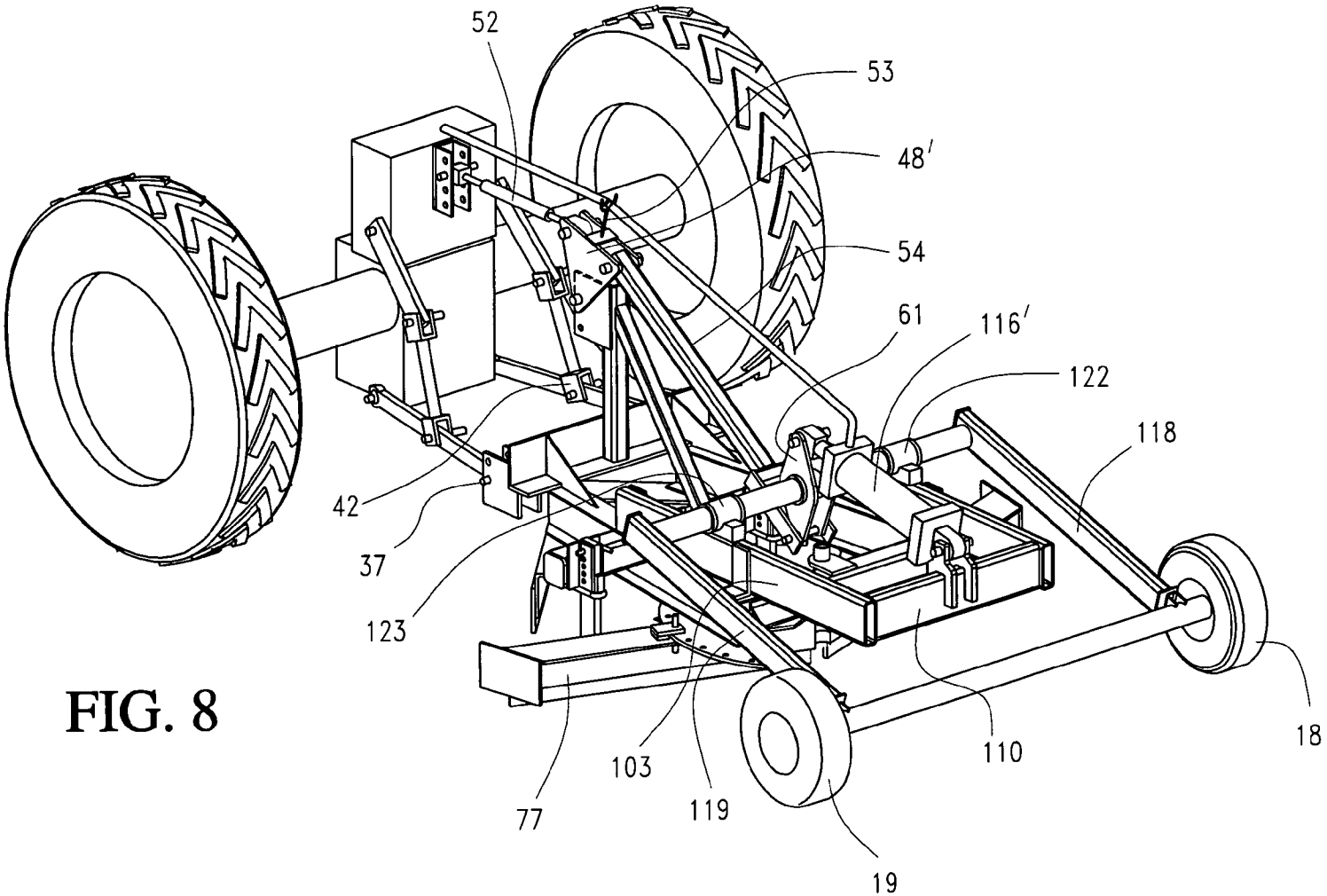
FIG. 8 is a perspective view of the apparatus, without the implement frame support having a broom, as shown in FIG. 7, and the apparatus is shown attached to a small tractor by a three-way hitch.

Briefly jumping ahead to FIG. 8, the trailer 15 can easily be attached to a standard three-point hitch of a tractor, as an alternative to the trailer towing ball or hitch pin. An operator would simply remove the attachment arm 20, by removing pins 36, 37, and the engagement pin connecting the attachment arm 20 with the end of pivot attachment actuator 52, and then attach the end plates 34, 35 and the unattached end of the pivot attachment actuator 52 to the tractor's three-point hitch as shown.

Returning now to FIGS. 1–3, pivot plate attachment block 40 is secured to the grader by a vertical post 42 and an inclined post 44 fixed to the grader; the block 40 being formed with holes 46. A pivot attachment plate 48 of the pivot attachment mechanism 16 is adjustably supported on attachment block 40 for pivotable movement at a connection where a pin or bolt 50 engages one of the holes 46 in block 40 and a corresponding hole in pivot plate 48. The pivot attachment mechanism 16 further includes a pivot attachment actuator 52, such as a turnbuckle, secured at one end by a rod end connected to attachment arm 20, and the pivot attachment actuator 52 is secured at its opposite end by a rod end connection and pin 51 to pivot plate 48. Still further, a support frame linkage member 54 of the attachment mechanism 16 is attached at one of its ends to pivot plate 48 by a pin connection 56. To complete the linkage, member 54 is attached at its opposite end to wheel support pivot plates 60, 61 by a pin connection 58. The wheel support pivot plates 60, 61 are pivotably supported on a wheel support assembly 70 of the carriage frame 17.

As briefly mentioned, it is preferred that the pivot attachment actuator 52 is a turnbuckle, however a hydraulic or pneumatic actuator can be used as an alternative. For purpose of this description, therefore, the pivot attachment actuator may be interchangeably referred to as turnbuckle 52, but should not be so limited because of the alternatives.

In the preferred embodiment, each rod end of the turnbuckle 52 is formed with external screw threads. Further, the turnbuckle 52 includes a sleeve having internal threads at each end. One rod end is connected to the turnbuckle sleeve by a right-hand screw thread engagement connection; the other rod end is connected to the opposite end of the turnbuckle sleeve by a left-hand screw thread engagement connection. The turnbuckle 52 has a wheel handle 59 to facilitate rotation of the turnbuckle sleeve about its axis relative to the rod end connections, which are prevented from turning with the wheel handle 59. The length of the turnbuckle 52 can be adjusted, lengthened and shortened, by rotating the turnbuckle sleeve about its longitudinal axis by the wheel handle 59 while holding against rotation the rod ends at each end of the turnbuckle. This lengthening and shortening movement of the turnbuckle causes the front end of the grader portion 14 to pivot about pins 36, 37 as the turnbuckle 52 pivots about pin 51 attached to the pivot plate 48. As described in more detail below, the grader portion 14 further pivots about a pair of journals 122,123. As a result, the angular inclination of the grader portion can be adjusted while maintaining the carriage frame 17 at an established height supported by the wheels 18, 19.

Figure 4:
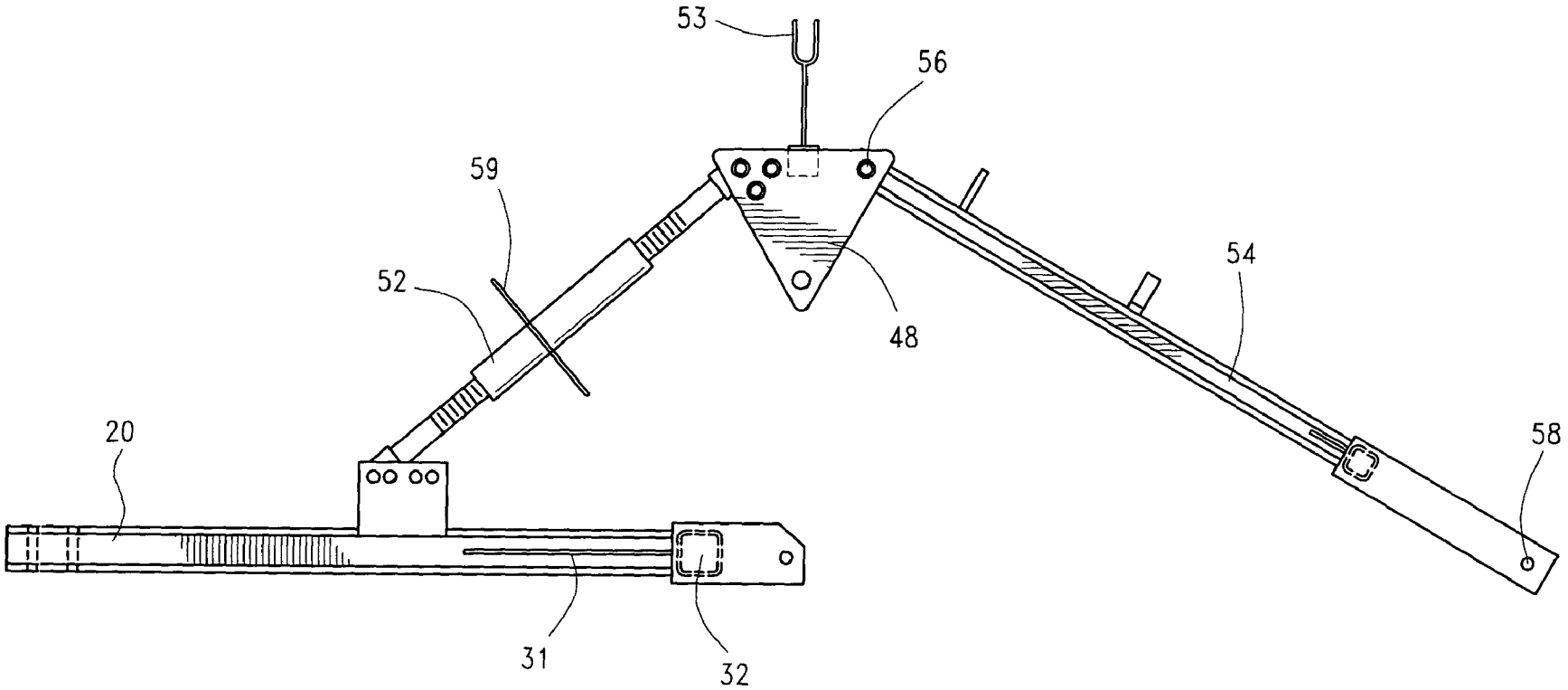
FIG. 4 is a side elevation view of a portion of an alternative pivot attachment mechanism.

FIG. 4 shows a slightly different embodiment of a portion of the pivot attachment mechanism. Therein, pivot plate 48' has a triangular shape, which is suited for attachment at each corner to the turnbuckle 52, block 40, and linkage member 54, respectively. Further, pivot plate 48' carries a forked bracket 53 for supporting a hose that connects a source of hydraulic or pneumatic pressure carried on the vehicle to a wheel support actuator 116, such as a hydraulic cylinder as described below, secured to the wheel support assembly 70 of the carriage frame 17. Bracket 53 permits the hose to be draped loosely above the apparatus and to be supported there away from interference with the trailer or the grader and its implements.

Figure 5:
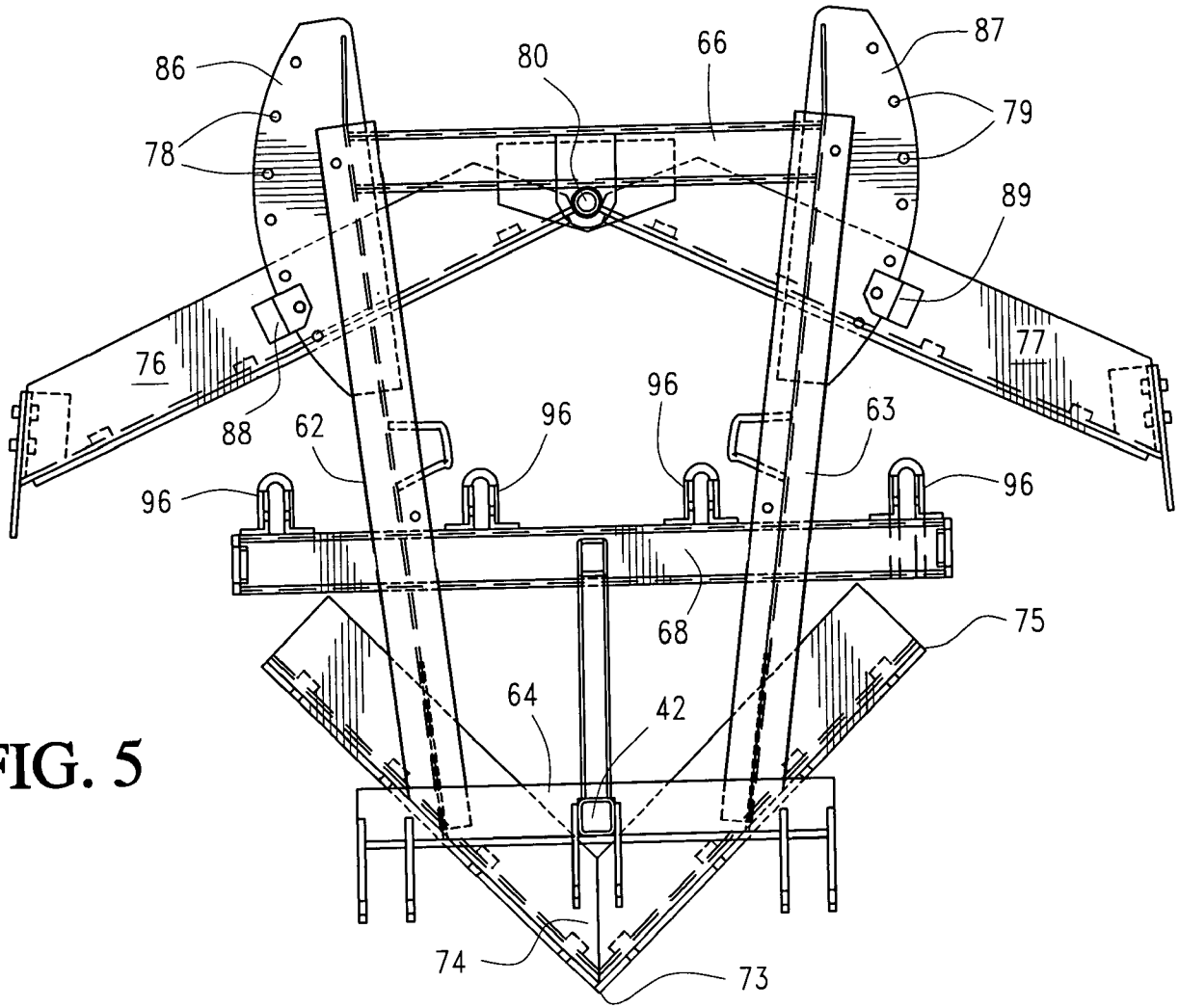
FIG. 5 is a plan view of the grader portion.

Turning now to FIG. 5, the grader portion 14 has a right side rail 62 and a left side rail extending along the length of the grader, the side rails 62, 63 being inclined mutually and spaced apart laterally further at the rear than at the front of the grader for structural support. The front end of the grader portion 14 has a front cross member 64 and the back end of the grader has a back cross member 66 secured to the right and left side rails 62 and 63.

Attached to the front cross member 64 below the side rails 62 and 63 is a V-shaped cutting blade 74 having an apex of the V-shape at the forward-most position of the grader portion 14 of the earth working apparatus 12. The lower edge of the cutting blade is substantially in a plane, whose angular disposition with respect to a horizontal plane is changed by adjusting the length of the turnbuckle 52 as previously described. The angle at which the cutting blade contacts the soil, gravel, sand or other material being moved by the apparatus is changed to suit surface conditions and the type of work being performed. For example, the angle between the plane of the lower blade edge and a horizontal plane can be opened so that the forward-most edge 73 of the blade is higher than the trailing edge 75 and the back end of the blade 74 contacts the work material at a shallow upward angle, just barely making contact with the work material. The angle between the plane of the lower blade edge and a horizontal plane can be closed so that the forward-most edge 73 of the blade is lower than the trailing edge 75 and the blade enters the work material at a steeper angle to cut a path or culvert therethrough.

Attached to the back cross member 66 is a pair of rear blades 76 and 77. One end of each rear blade 76, 77 is pivotally attached to the back cross member 66 by a rear blade hinge 80, which is supported on the back cross member 66 by a plate and gusset. The axis of the hinge 80 is substantially vertical and perpendicular to the plane of the upper surface of the rear blades 76, 77.

The angular position of the rear blades 76, 77 is adjustably secured about the axis of the hinge 80 by attachment of rear blade 76 to adjustment plate 86 and by attachment of rear blade 77 to adjustment plate 87. Adjustment plate 86 is located below and attached to the right side rail 62; adjustment plate 87 is located below and attached to the left side rail 63. Near the outermost perimeter of each adjustment plate 86, 87 are a plurality of positioning holes 78, 79. Adjustment pin blocks 88, 89 are attached to rear blades 76 and 77, respectively. Each adjustment pin block 88, 89 provides a gap between the respective rear blade and the corresponding mounting block permitting each rear blade to slide freely in its respective gap relative to the adjustment plate. Each adjustment pin block 88, 89 has a hole for registration and alignment with one of the positioning holes 78, 79 in the corresponding adjustment plate 86, 87. Rear blade 76 may be secured at various angular positions by rotating the rear blade 76 about the pivoting hinge 80 and securing the rear blade 76 to adjustment plate 86 using a locking pin. In like fashion, the rear blade 77 may be secured at various angular positions by rotating the rear blade 77 about the pivoting hinge 80 and securing the rear blade 77 to the adjustment plate 87 also using a locking pin. Still further, the rear blades 76, 77 may be removed completely or changed from a pair of rear blades with a planer lower edge to a pair with a serrated lower edge (or vise-versa) by removing the hinge pin from the rear blade hinge 80 and the locking pins from the adjustment plates 86, 87, and securing the pins once again when the chosen rear blades are in place as described above.

Located between rear blades 76 and 77 and the V-shaped cutting blade 74 is mounted a center cross-member 68 traversing right and left side rails 62 and 63. Secured on the center cross-member 68 are adjustable, laterally-spaced scarifiers 94, attached to member 68 by scarifier brackets 96. The scarifiers extend below cross-member 68, and they are removable from the grader by releasing attachment bolts and removing each scarifier from its bracket.

Figure 6:
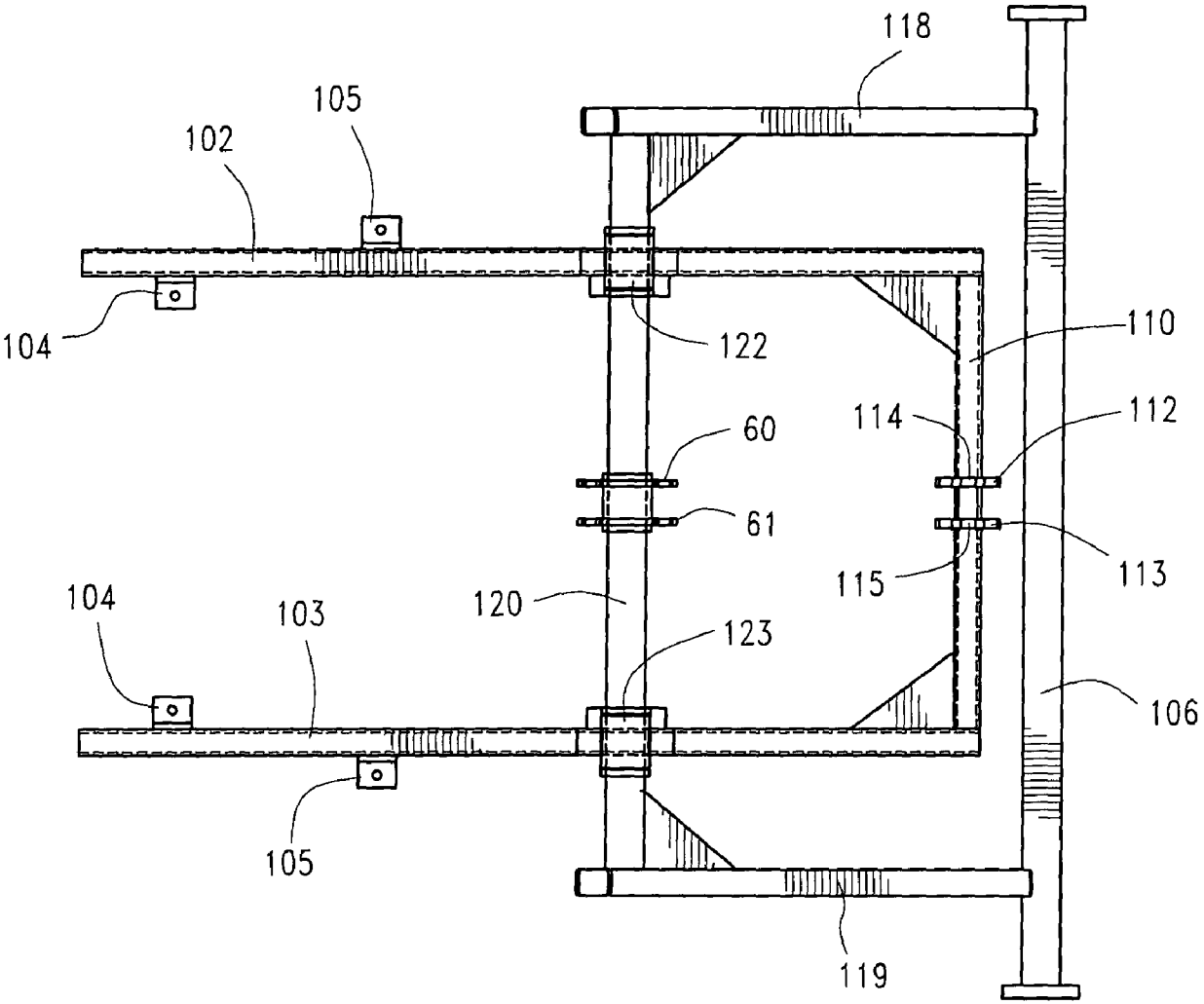
FIG. 6 is a plan view of a portion of the carriage frame.

Turning now to FIG. 6, the carriage frame 17 for supporting the grader 12 on the wheels 18, 19 further includes a right side rail 102 and a left side rail 103, these rails being located on the upper surface of the side rails 62, 63 of the grader, respectively, and secure thereto at bolted brackets 104, 105. The back end of the rails 102, 103 supports a cross member 110, which carries the wheel support assembly 70 having two laterally spaced plates 112, 113 extending upward above the upper surface of the cross member 110. Each plate is formed with laterally directed, mutually aligned holes 114, 115 for connection to an end of a wheel support actuator 116, such as a ratchet jack or hydraulic cylinder, described in more detail below.

The wheel support assembly 70 of the carriage frame 17 further includes a right side arm 118 and a left side arm 119; a pivot axle or cylindrical jack shaft 120 extending laterally between and secured to the front end of arms 118, 119; and an axle shaft 106 extending laterally between and supported on the arms 118, 119. The trailer wheels 18, 19 are supported rotatably on the axle shaft 106. At least a portion of the length of the outer surface of the jack shaft 120 is in the form of a circular cylinder. Jack shaft 120 is supported for rotation on journals 122, 123 located on and secured to the upper surface of the side rails 102, 103. Preferably, each journal has a concave cylindrical surface, complementary to that of the jack shaft 120, for supporting the grader 14 at least partially on the wheels 18, 19, and additional support being provided by the towing vehicle by the attachment arm 20 of the attachment mechanism 16.

The wheel support pivot plates 60, 61 are secured to the jack shaft 120 for movement with the jack shaft as it pivots on the journals 122, 123. Pivot plates 60, 61 are mutually spaced laterally and formed with laterally directed, aligned holes for a pin connection at 58 to linkage member 54, seen in FIG. 3. Pivot plates 60, 61 are formed also with aligned holes for a pin connection at 124 to the wheel support actuator 116. The connections 58 and 124 are spaced angularly about the axis of the jack shaft 120.

Located at the rear of the carriage frame is an implement frame support that includes a center post 130, releasably secured to the carriage frame, and lateral posts 132, 133, secured at release pins 134, 135 to the rails 102, 103. The posts 130, 132, 133 are stabilized by a cross member 137, and they support a laterally extending rail 136 having a cross section, preferably in the form of an angle. The rail 136 is supported in the position shown in FIGS. 1–3 by using both pin connections 134 and 135 to support the posts 132, 133 vertically. However, the rail 136 can also be rotated and lowered by pivoting it on only one of the release pins 134, 135 and removing the other release pin. A broom having long, coarse bristles can be attached to the angle 136 such that the bristles contact the ground under the weight of the implement frame for sweeping a playing surface or spreading fine topsoil at a worksite before seeding.

In operation, the angular relation between an imaginary horizontal plane and the grader portion 14, namely the lower edge of the V-shaped cutting blade 74 and rear blades 76 and 77, can be changed by altering the length of the turnbuckle 52. For example, if the turnbuckle 52 is lengthened by rotating its sleeve relative to the rod ends, grader portion 14 rotates counterclockwise on the pins 36, 37, when viewed as in FIG. 3, as the corresponding end of the attachment arm 20 is lowered. This will lower the front end of the grader portion. The wheel support assembly holds the back end of the grader portion at its adjusted height, relative to the ground, since the back end of the grader portion 14 pivots with the carriage frame about the journals 122, 123 of the wheel support assembly 70. As a result, the V-shaped nose 73 will be closed and pointed downward so that it will dig into the earth as the vehicle moves forward. Further, the lower edge of the rear blades 76, 77 will be positioned at the corresponding angle but relatively higher then the V-shaped nose 73. With the V-shaped cutting blade 74 tilted forward and the rear blades 76 and 77 lifted entirely off the ground, a ditch can be cut using the apex 73 of the V-shaped cutting blade 74 as the operator travels forward.

If the turnbuckle 52 is shortened by rotating its sleeve relative to the rod end attachments, grader portion 14 rotates clockwise on pins 36, 37 as the attachment arm 20 is lifted. This then raises the front end of the grader portion. Again, the wheel support assembly holds the back end of the grader portion at its adjusted height, relative to the ground. The back end of the grader pivots with the carriage frame about the journals 122, 123 of the wheel support assembly 70. As a result, the V-shaped nose 73 will be open and pointed upward, relatively higher then the rear blades 76, 77. This allows the operator to lift the V-shaped cutting blade 74 entirely off the ground to use only the rear blades 76 and 77 for grading or back dragging.

Figure 7:
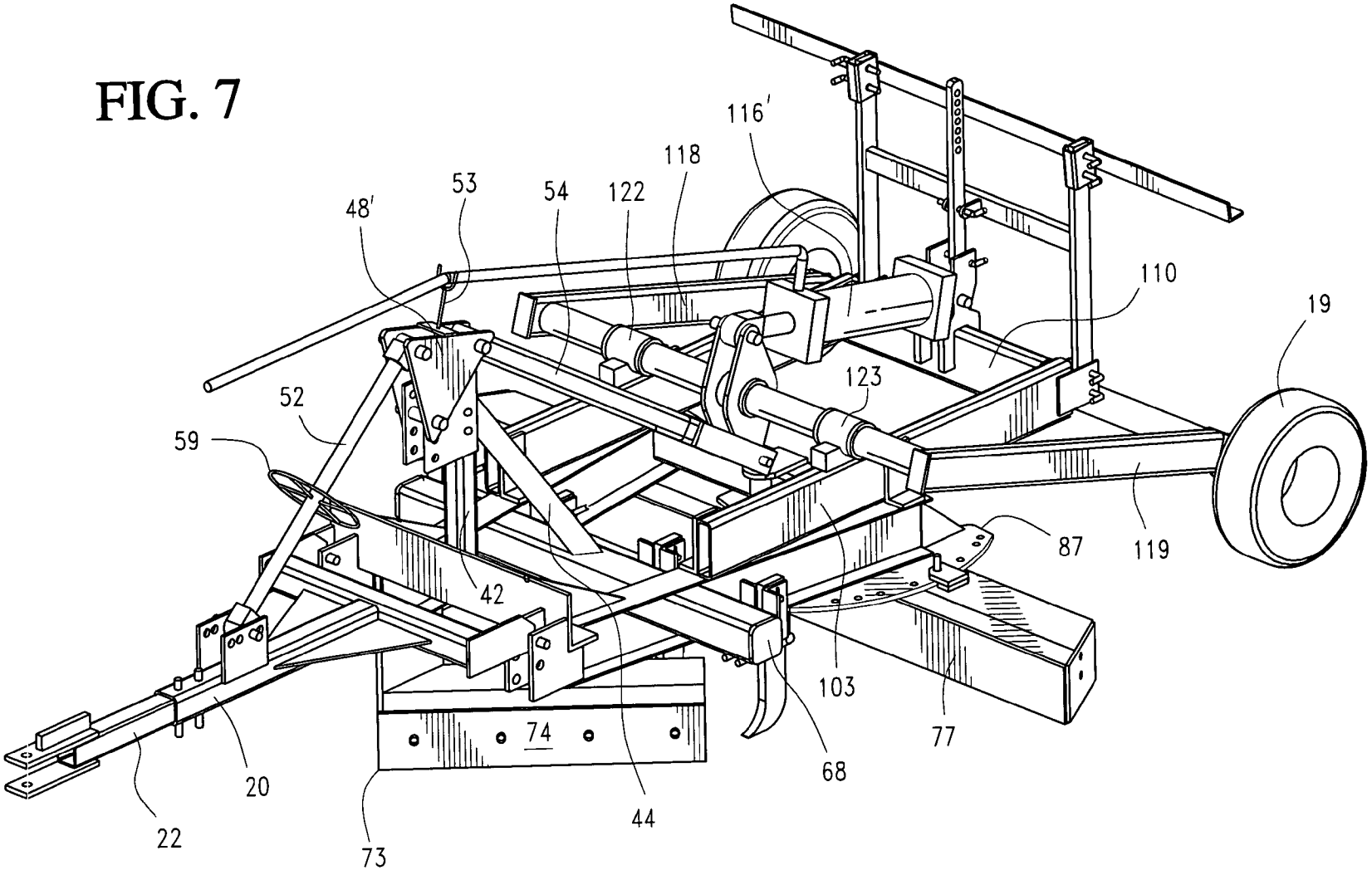
FIG. 7 is a perspective view of the apparatus with a modified carriage frame and the modified pivot attachment mechanism shown in FIG. 4.

Further, the height of the grader portion 14 can be changed relative to the ground by altering the length of the wheel support actuator 116. The wheel support actuator 116 can be a manually operated by a ratchet jack (depicted in FIGS. 1–3) or an automatically controlled hydraulic cylinder (depicted in FIGS. 7–8) connected to the pivot plates 60, 61. Viewing FIG. 7, a hydraulic cylinder 116' is connected to a hydraulic pressure source to automatically manipulate the wheel support assembly 70 of the carriage frame 17. By extending the wheel support actuator, the wheel support pivot plates 60, 61 and jack shaft 120 rotate counterclockwise, and raise the trailer wheels 18, 19 relative to the grader, thereby lowering the same. By shortening the wheel support actuator, pivot plates 60, 61 and jack shaft 120 rotate clockwise, thereby lowering the trailer wheels to raise the grader off of the ground. When the trailer wheels are raised and lowered, the angular inclination of the grader portion 14 does not change since turnbuckle 52 should be locked in its select extension.

In summary, the height and angular disposition of the cutting and rear blades can be raised and lowered relative to the horizontal plane over a wide range of adjustment by changing the length of the wheel support actuator 116, 116' and the turnbuckle 52. The grader can be quickly adjusted to accomplish the desired task, to the local topography of a worksite and to the amount of earth to be moved with each pass of the grader over the area.

Finally, the pivot attachment mechanism 16, wheel support assembly 70 and extended length of the trailer 15 provide energy absorbing capability when the apparatus is moving, when the turnbuckle 52 and wheel support actuator 116 are set at adjusted lengths. More specifically, the play in the pivoting action of the pivot attachment plate 48 or 48' about the pivot plate attachment block 40, in combination with the play in the pivotability of the jack shaft 120 on journals 122, 123 of the wheel support assembly 70 and extended length of the trailer from the trailer hitch to the wheels 18,19, dissipates sudden variations in work site elevation and vibrating energy transmitted by wheel movement. Therefore, if the pulling vehicle passes over a high area on the work site, the grader portion remains relatively level since the vertical movement of the vehicle is dissipated accordingly.

From the foregoing, it will be seen that this invention is well adapted to attain all the advantages set forth, together with other advantages. It will be understood that certain features and combinations are of utility and may be employed without reference to other features and combinations. It is to be understood that all the subject matter described here or shown in the accompanying drawings is to be interpreted as illustrative and not in a limiting sense. In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. An apparatus for earth working and ground leveling, comprising:

a trailer having a hitching assembly;

a grader secured to the trailer, the grader having a front, a rear and at least two rear blades, each rear blade supported on a hinge for attachment to a corresponding adjustment plate for adjustable angular positioning about the hinge;

the trailer further including a carriage frame secured to the grader, the carriage frame including a wheel support assembly having a lateral directed axis, laterally spaced wheels supported on the wheel support and spaced therefrom for providing ground support for the apparatus, the wheel support assembly further comprising laterally spaced arms supporting the wheels, a journal and a jack shaft aligned with the axis, the jack shaft being secured to the arms and supported on the journal at a position spaced from the wheels and above the rear blades of the grader, for pivoting movement about the axis, a first actuator having a first end, a second end secured to the jack shaft and a length for producing a first actuating movement for pivoting the wheels about the axis in response to movement of the first actuator, so that pivoting movement of the jack shaft raises and lowers the wheels relative to the grader;

a second actuator having an adjustable length and being secured for producing a second actuating movement for angularly positioning the front of the grader; and a mechanism connecting the first actuator and second actuator.

2. The apparatus of claim 1, wherein:

the second actuator having an end secured to a trailer arm on the hitching assembly and an opposite end secured to the mechanism; and the pivoting movement of the wheels about the axis in a first direction occurring in response to lengthening the first actuator, and pivoting movement of the wheels about the axis in a second direction occurring in response to shortening the first actuator.

3. The apparatus of claim 1, wherein:

the second actuator comprises a turnbuckle having a first end attachment secured to the hitching assembly and a second end attachment secured to the mechanism, a rotatable sleeve engaged with the first end attachment and second end attachment.

4. The apparatus of claim 1, wherein:

the first actuator comprises a hydraulic cylinder, pivoting movement of the wheels about the axis in a first direction occurring in response to lengthening the first actuator, and pivoting movement of the wheels about the axis in the second direction occurring in response to shortening the first actuator.

5. The apparatus of claim 1, wherein:

the wheel support assembly comprises a wheel support plate secured to the jack shaft for movement about the axis, the second end of the first actuator secured to the wheel support plate for transmitting movement of the first actuator about the axis in response to the actuator thereby pivoting the wheels; and the mechanism includes a post supported on the grader and a pivot plate pivotally supported on the post and secured to the second actuator, and a linkage connecting the pivot plate and the wheel support plate.

6. The apparatus of claim 1, wherein:

the first actuator end being secured to a fixed cross member of the carriage frame for producing a force tending to oppose pivoting movement of the wheel support assembly about the axis.

7. The apparatus of claim 1, wherein the wheel support assembly further comprises:

a wheel support plate driveably connected to the second end of the first actuator and secured to the jack shaft for angular movement therewith about the axis in response to the first actuator.

8. The apparatus of claim 1, wherein the grader comprises:

at least two side rails, each side rail supporting one of the adjustment plates;

a cutting blade located at the front of the grader, attached to a lower surface of the side rails, the cutting blade having a V-shaped nose and a length extending laterally and rearward from the nose; and two rear blades located behind the cutting blade.

9. The apparatus of claim 1, further comprising:

an implement frame having a lateral rail for supporting and releasably securing an implement to the rail, the implement frame being supported on the carriage frame alternately in a first position where the lateral rail is raised from the ground, and in a second position where the lateral rail is pivoted on the carriage frame toward the ground from the first position.

10. An apparatus for earth working and ground leveling, comprising:

a grader to which earth working and ground leveling implements can be secured, the grader having a front, back and first and second laterally spaced side rails, of the implements a cutting blade is located at the front of the grader, attached to a lower surface of the side rails, the cutting blade having a V-shaped nose and a length extending laterally and rearward from the nose toward the back;

a trailer secured to the grader and connectable to a vehicle by a trailer arm, the trailer further including;

a carriage frame having third and fourth laterally spaced side rails firmly secured to the first and second side rails of the grader, laterally spaced wheels, a wheel support assembly having a journal with a lateral directed axis, the wheel support assembly further including laterally spaced arms supporting the wheels and a jack shaft secured to the arms, the jack shaft being supported pivotably on the journal at a position spaced from the wheels and above the lower surface of the side rails of the grader; and a first actuator including a first end secured against displacement to a fixed cross member of the carriage frame and a second end driveably connected to the jack shaft eccentric of the axis for producing a force tending to oppose pivoting movement of the wheel support assembly about its journal axis; and a second actuator having an adjustable length and being secured for producing a second actuating movement for angular adjustment of the front of the grader.

11. The apparatus of claim 10, wherein:

the cutting blade having a lower edge located substantially in a plane.

12. The apparatus of claim 10, wherein the first actuator has an adjustable length for pivoting the wheels about the axis in response to an adjustment of said length.

13. The apparatus of claim 10, further comprising:

an attachment plate connecting the first actuator and the jack shaft, for pivoting the wheels about the journal axis in response to movement of the first actuator, the pivoting movement of the wheels about the journal axis raising and lowering the wheels relative to the grader.

14. The apparatus of claim 13, further comprising:

a post supported on the grader;

a pivot plate pivotably supported on the post and secured to the second actuator; and a linkage connecting the pivot plate and the attachment plate.

15. The apparatus of claim 14, wherein:

the second actuator comprises a turnbuckle having a first end attachment secured to the trailer arm and a second end attachment secured to the pivot plate, a rotatable sleeve engaged with the first end attachment and second end attachment.

16. An earth working apparatus that attaches to a vehicle, the apparatus comprising:

a grader having a front and a back to which earth working implements can be secured, the grader including first and second laterally spaced side rails;

a trailer having a hitching assembly secured to the front of the grader, the trailer further including;

a carriage frame secured to the first and second side rails of the grader, the carriage frame having laterally spaced wheels, a journal secured to the carriage frame having a lateral directed axis, laterally spaced arms supporting the wheels, a jack shaft secured to the arms and supported pivotably on the journal at a position spaced from the wheels;

a wheel support actuator including a first end secured against displacement above the laterally spaced side rails of the grader to a fixed cross member of the carriage frame, and a second end driveably connected to the jack shaft eccentric of the laterally directed journal axis for producing a force tending to oppose pivoting movement about the journal axis positioned above at least a lower surface of the grader side rails;

a post supported on the grader;

a first pivot plate pivotably supported on the post and secured to a pivot attachment actuator, the pivot attachment actuator having a first end secured to the hitching assembly of the trailer and a second end secured to the first pivot plate, annular movement of the grader being relative to lengthening the pivot attachment actuator;

a second pivot plate secured to the jack shaft; and a linkage connecting the first pivot plate and the second pivot plate.

17. The apparatus of claim 16, wherein the grader includes:

a cutting blade having a V-shaped nose, the cutting blade extending laterally and rearward from the nose of the cutting blade, and the cutting blade including a lower edge located substantially in a plane.

18. The apparatus of claim 16, wherein:

the pivot attachment actuator comprises a turnbuckle.

19. The apparatus of claim 16, further comprising:

an implement frame supported on the carriage frame away from ground contact and for pivotable movement toward the ground.

* * * * *